US005878932A

United States Patent [19]

Huang

[11] Patent Number: 5,878,932

[45] Date of Patent: Mar. 9, 1999

[54] ADHESIVE TAPE DISPENSER

[76] Inventor: Harrison Huang, No. 23, Lin T'So Rd., Sheng Kang, Taichung Hsien, Taiwan

[21] Appl. No.: 759,218

[22] Filed: Dec. 5, 1996

[51] Int. Cl.[6] ..... B26F 3/02; B65D 85/672

[52] U.S. Cl. ..... 225/65; 225/66; 242/588; 242/598.3

[58] Field of Search ..... 225/56, 57, 58, 225/59, 65, 66, 77; 242/588, 598.3, 598.5; 156/527, 577

[56] References Cited

U.S. PATENT DOCUMENTS

| | | | |
|---|---|---|---|
| 2,215,053 | 9/1940 | Reese | 242/598.3 |
| 2,545,500 | 3/1951 | Stanley et al. | 225/66 |
| 2,718,924 | 9/1955 | Robbins | 225/66 X |
| 2,788,181 | 4/1957 | Anderson | 225/66 X |
| 3,109,570 | 11/1963 | Maddalena | 225/66 |
| 3,134,526 | 5/1964 | Schleicher | 225/66 X |
| 3,155,301 | 11/1964 | Kusek | 225/66 |
| 3,410,465 | 11/1968 | Costello | 225/65 |
| 3,556,367 | 1/1971 | Ikeda | 225/65 |
| 4,780,172 | 10/1988 | Shea | 156/527 |
| 5,454,500 | 10/1995 | Chen | 225/46 |
| 5,468,332 | 11/1995 | Dretzka et al. | 156/527 |
| 5,759,342 | 6/1998 | Luhman et al. | 156/577 |

FOREIGN PATENT DOCUMENTS

| | | | |
|---|---|---|---|
| 781786 | 4/1968 | Canada | 242/588 |
| 2632226 | 2/1977 | Germany | 242/588 |
| 62-36269 | 2/1987 | Japan | 225/65 |
| 454731 | 10/1936 | United Kingdom | 242/598.3 |
| 645997 | 11/1950 | United Kingdom | 225/66 |

*Primary Examiner*—Eugenia A. Jones
*Attorney, Agent, or Firm*—Browdy and Neimark

[57] ABSTRACT

An adhesive tape dispenser comprises a main body, a cutter, and a locating member. The main body has two parallel shoulders for accommodating an adhesive tape roll. The cutter is fastened at one end of the main body for severing the adhesive tape. The locating member is mounted detachably between the two shoulders for preventing the shoulders from being deformed by the pressure of a hand holding the shoulders in the course of the dispensing of the adhesive tape.

2 Claims, 3 Drawing Sheets

ADHESIVE TAPE DISPENSER

FIELD OF THE INVENTION

The present invention relates generally to an adhesive tape, and more particularly to an adhesive tape dispenser.

BACKGROUND OF THE INVENTION

As shown in FIG. 1, an adhesive tape dispenser 10 of the prior art comprises two shoulders 11 which are provided respectively with a lug 12 for holding an adhesive tape roll 20. The dispenser 10 further comprises a cutter 13 for cutting the adhesive tape. In dispensing the adhesive tape, the shoulders 11 are held by the hand of a person dispensing the adhesive tape.

Such a prior art adhesive tape dispenser 10 as described is defective in design in that the shoulders 11 are so pliable as to allow the shoulders 11 to be stretched out to facilitate the mounting of the adhesive tape roll 20, and that the pliable shoulders 11 are rather vulnerable to deformation caused by the pressure of the hand holding the shoulders 11, thereby resulting in the obstruction of the adhesive tape roll 20 by the shoulders 11. The dispensing of the adhesive tape is therefore hindered.

SUMMARY OF THE INVENTION

The primary objective of the present invention is to provide an improved dispenser capable of dispensing the adhesive tape easily and smoothly.

In keeping with the principle of the present invention, the foregoing objective of the present invention is attained by an adhesive tape dispenser, which comprises a main body, a cutter, and a locating member. The main body has two shoulders parallel and opposite to each other for mounting an adhesive tape roll. The shoulders are provided respectively with a pivoting portion. The cutter is mounted at one end of the main body for severing the adhesive tape. The locating member is mounted detachably between the two shoulders for keeping the shoulders apart by a predetermined interval.

The foregoing objective, features, functions, and advantages of the present invention will be more readily understood upon a thoughtful deliberation of the following detailed description of the embodiments of the present invention in conjunction with the accompanying drawings.

DETAILED DESCRIPTION OF THE INVENTION

Figure 1:
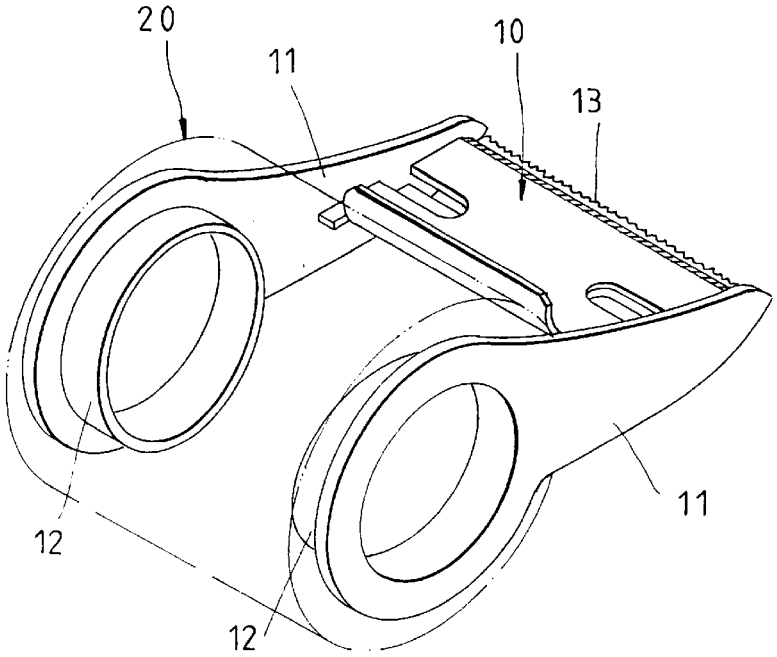
FIG. 1 PRIOR ART
FIG. 1 shows a perspective view of an adhesive tape dispenser of the prior art.
Figure 2:
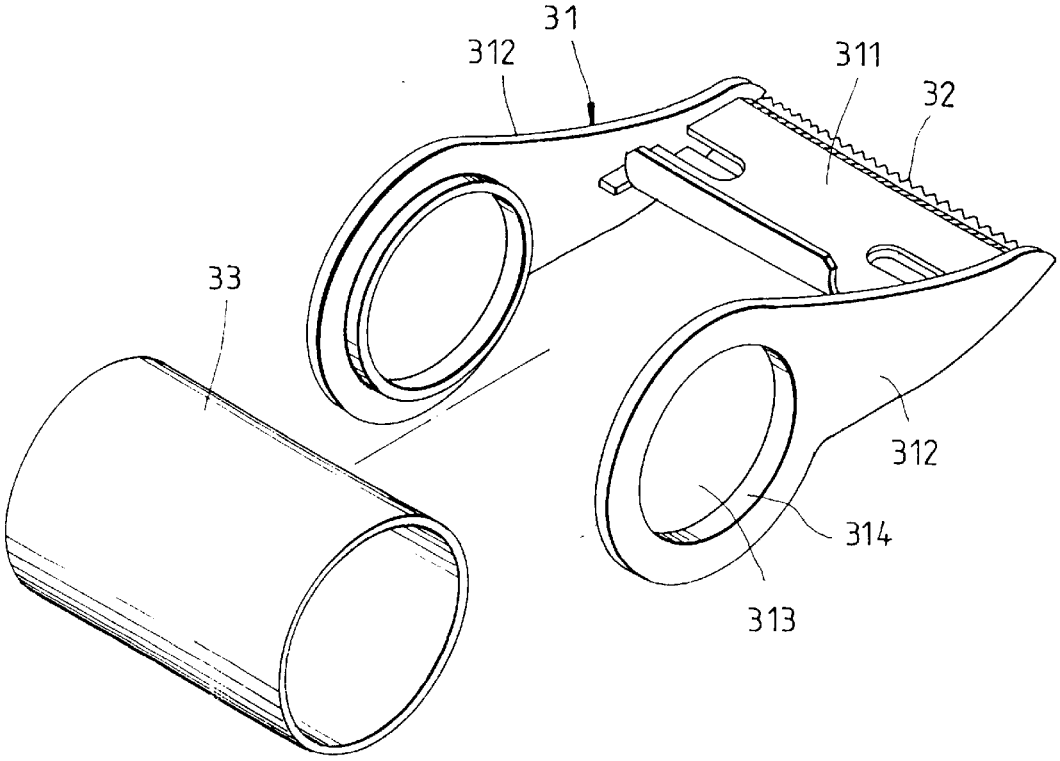
FIG. 2 shows an exploded view of a first preferred embodiment of the present invention.
Figure 3:
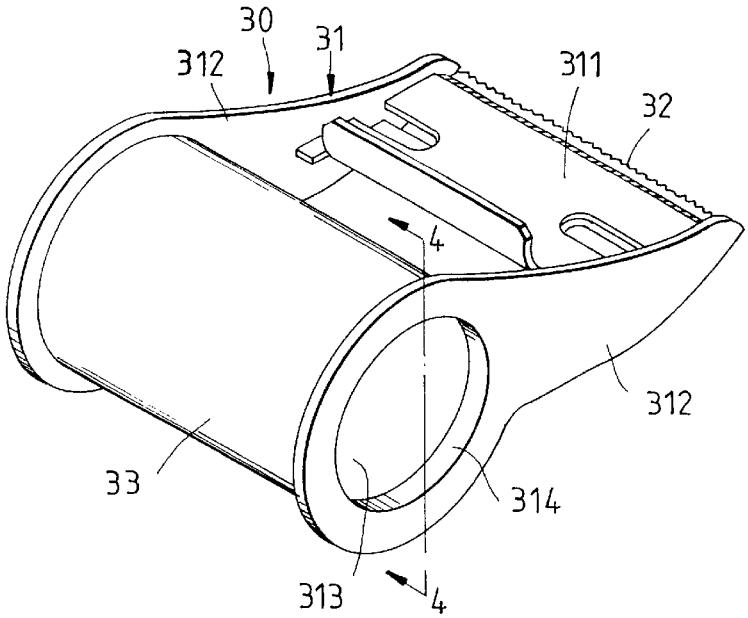
FIG. 3 shows a perspective view of the first preferred embodiment in combination according to the present invention.
Figure 4:
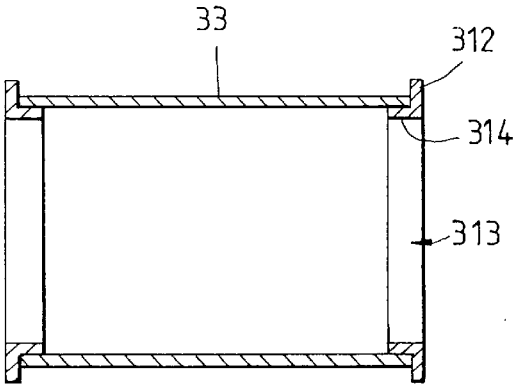
FIG. 4 shows a sectional view taken along the direction indicated by a line 4—4 as shown in FIG. 3.

As illustrated in FIGS. 2–4, an adhesive tape dispenser 30 of the first preferred embodiment of the present invention comprises a main body 31, a cutter 32, and a locating member 33.

The main body 31 has a body portion 311 and two parallel shoulders 312 opposite in location to each other and extending along two sides of the body portion 311. The two shoulders 312 are provided with through holes 313 opposite in location to each other, and with pivoting portions 314 extending respectively and inwardly from the circumferential edges of the two through holes 313.

The cutter 32 is mounted at one end of the main body 31 for severing the adhesive tape.

The locating member 33 is detachably fastened with the two pivoting portions 314 such that it is located between the two shoulders 312 for keeping the shoulders 312 apart by an interval.

The pivoting portions 314 are of a ring-shaped construction, whereas the locating member 22 is tubular in construction. The shoulders 312 are pliable so as to permit both ends of the tubular locating member 33 to engage the two pivoting portions 314. In combination, the locating member 33 is first fitted into the axial hole of the adhesive tape roll before both ends of the locating member 33 are engaged with the pivoting portions 314. In other words, the locating member 33 serves as a shaft of the adhesive tape roll as well as a means for keeping the shoulders 312 apart by a predetermined distance so as to prevent the shoulders 312 from being deformed by the pressure of a hand holding the shoulders 312.

Figure 5:
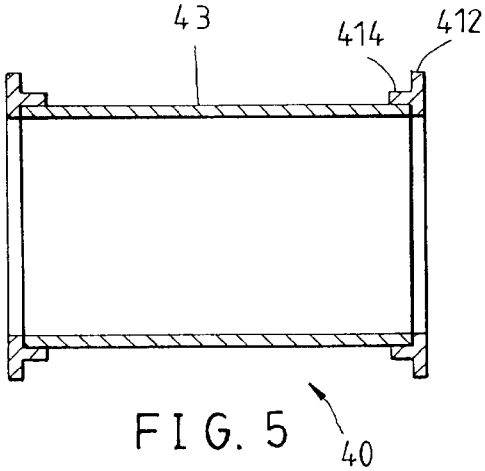
FIG. 5 is similar to FIG. 4 for illustrating a second preferred embodiment of the present invention.

As shown in FIG. 5, an adhesive tape dispenser 40 of the second preferred embodiment of the present invention comprises two shoulders 412, which are provided respectively with two pivoting portions 414 for holding locating member 43.

Figure 6:
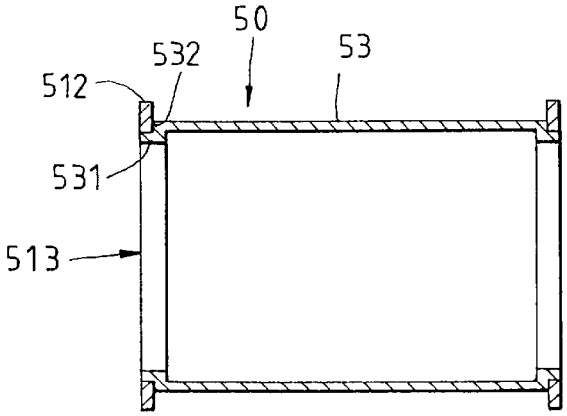
FIG. 6 is similar to FIG. 4 for illustrating a third preferred embodiment of the present invention.

As shown in FIG. 6, an adhesive tape dispenser 50 of the third preferred embodiment of the present invention comprises two shoulders 512, which are provided respectively with a through hole 513. Each end of locating member 53 is provided with an insertion portion 531 and a shoulder face 532, which are engaged with the through holes 513 of the shoulders 512.

The locating members described above are tubular in shape and may be provided with a plurality of perforations for saving the material of which the locating members are made. The pivoting portions described above may be of a ring-shaped construction or a columnar construction.

Figure 7:
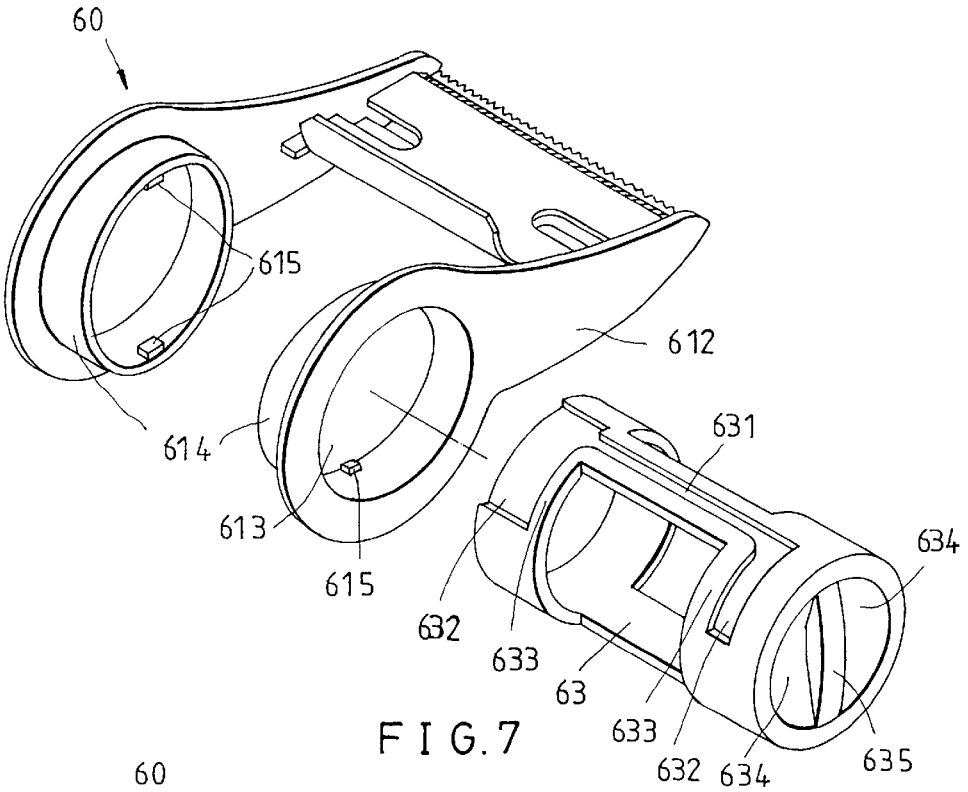
FIG. 7 shows an exploded view of a fourth preferred embodiment of the present invention.
Figure 8:
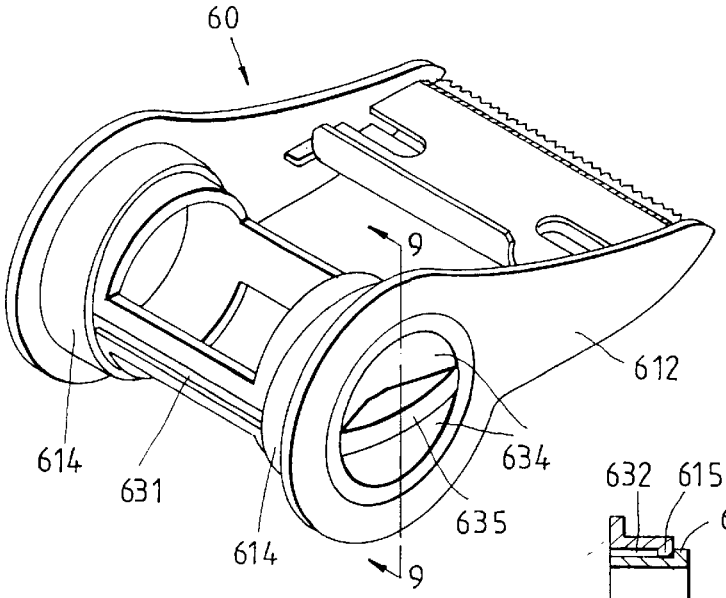
FIG. 8 shows a perspective view of the fourth preferred embodiment in combination according to the present invention.
Figure 9:
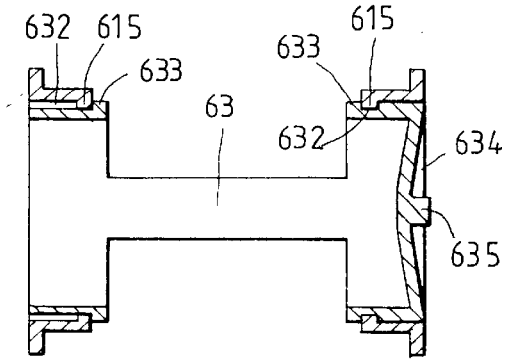
FIG. 9 shows a sectional view taken along the direction indicated by a line 9—9 as shown in FIG. 8.

An adhesive tape dispenser 60 of the fourth preferred embodiment of the present invention is illustrated in FIGS. 7, 8, and 9. It is composed of two shoulders 612, which are provided respectively with a pivoting portion 614 a round through hole 613 having in the round inner wall of each of pivoting portions 614 thereof locating 615 each of which is opposite in location to each other. A locating member 63 of a cylindrical construction is provided in the outer wall thereof with two locating grooves 631 opposite in location to each other and engageable with the two locating projections 615 of the shoulders 612. The locating grooves 631 are extended along the direction of the longitudinal axis of the locating member 63 and are provided respectively with a retaining slot 632 normal to the locating groove 631 and having therein a retaining portion 633. The shoulders 612 are provided respectively with a tape holder 614. In combination, the adhesive tape roll is first held by the tape holders 614 of the two shoulders 612 before the locating member 63 is received in the round through holes 613 of the shoulders 612 such that the locating grooves 631 of the locating member 63 are engaged with the locating projections 615 of the round through holes 613. The locating member 63 is then turned such that the retaining portions 633 are engaged securely with the locating projections 615 of the shoulders 612. As a result, the shoulders 612 are kept apart by a predetermined distance. Located in the outer wall of one end of the longitudinal axis of the locating member 63 is a grip portion 635 to facilitate the turning of the locating member 63 with hand. The grip portion 635 is located between two recesses 634. The locating member 63 can be disengaged with the shoulders 612 by rotating the locating member 63 in the reverse direction. The locating member 63 may be provided with a plurality of perforations for saving the material of which the locating member 63 is made. In addition, the locating projections 615 and the locating grooves 631 may be two or more in number.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An adhesive tape dispenser comprising:

a main body provided with two flexible shoulders parallel to each other when accommodating an adhesive tape roll, each of said two shoulders provided respectively with a cylindrical pivoting portion;

a cutter fastened at one end of said main body for severing a segment of the adhesive tape roll; and a cylindrical locating member mounted detachably between said two flexible shoulders such that a first and second end of said locating member is respectively engaged with each said cylindrical pivoting portion after the two flexible shoulders are spread apart to accommodate engagement of said first and second end of said locating member, wherein each said pivoting portion is provided respectively with a round through hole having on an inner wall thereof at least one locating projection; and wherein said cylindrical locating member is provided in an outer wall thereof with at least one locating groove extending along the direction of a longitudinal axis of said cylindrical locating member, said locating groove provided with a retaining slot normal to said locating groove and having a retaining portion engaged with said locating projection on said inner wall of said round through hole of said pivoting portion.

2. The adhesive tape dispenser as defined in claim 1, wherein said locating member is provided with a grip portion located in an outer wall of one end of the longitudinal axis of said cylindrical locating member to facilitate the turning of said locating member by hand.

* * * * *